US005911532A

United States Patent [19]

Evancic

[11] Patent Number: 5,911,532

[45] Date of Patent: Jun. 15, 1999

[54] TOOTHBRUSH

[76] Inventor: Dorlyn Robert Evancic, #203-1240 Quayside Drive, New Westminster, British Columbia, Canada, V3M 6H1

[21] Appl. No.: 09/065,642

[22] Filed: Apr. 23, 1998

[51] Int. Cl.[6] ..... A46B 11/02

[52] U.S. Cl. ..... 401/191; 401/190; 401/281

[58] Field of Search ..... 401/281, 191, 401/123, 190

[56] References Cited

U.S. PATENT DOCUMENTS

| | | | |
|---|---|---|---|
| 1,504,143 | 8/1924 | Roberts . | |
| 1,610,831 | 12/1926 | Wallace . | |
| 1,860,911 | 5/1932 | Trimble . | |
| 1,905,960 | 4/1933 | Philipps | 401/191 |
| 2,243,774 | 5/1941 | Fresh . | |
| 2,642,606 | 6/1953 | Aschenbach . | |
| 2,717,101 | 9/1955 | Van Handel . | |
| 2,756,450 | 7/1956 | Stolarevsky | 401/191 |
| 2,766,472 | 10/1956 | Durrett . | |
| 3,256,894 | 6/1966 | Sherman . | |
| 3,261,367 | 7/1966 | Pickering . | |
| 3,391,980 | 7/1968 | Duncan . | |
| 3,612,706 | 10/1971 | Verga . | |
| 3,995,648 | 12/1976 | Kuryla . | |
| 4,013,370 | 3/1977 | Gingras . | |
| 4,155,663 | 5/1979 | Cerquozzi . | |
| 4,408,920 | 10/1983 | Walther et al. . | |
| 4,421,433 | 12/1983 | Villanueva . | |
| 4,717,278 | 1/1988 | Kemeny . | |
| 4,826,341 | 5/1989 | Kwak . | |
| 5,039,244 | 8/1991 | Cheng . | |
| 5,062,728 | 11/1991 | Kuo . | |
| 5,158,383 | 10/1992 | Glover et al. . | |
| 5,407,287 | 4/1995 | Braun et al. . | |
| 5,425,591 | 6/1995 | Contreras et al. | 401/191 |

FOREIGN PATENT DOCUMENTS

| | | | |
|---|---|---|---|
| 2620314 | 3/1989 | France | 401/191 |

*Primary Examiner*—Steven A. Bratlie
*Attorney, Agent, or Firm*—Kolisch Hartwell Dickinson McCormack & Heuser

[57] ABSTRACT

A toothbrush comprising, in combination, a replaceable container for holding toothpaste having an outlet and a brush portion having a plurality of projecting bristles and an extension adapted to be releasably connected to the replaceable container. The extension includes a recess. A tooth paste dispensing system comprising a tube and an actuating mechanism are mounted to the extension. The tube is connected to the outlet of the tooth paste container and has an open end. The actuating mechanism is operated to pivot the tube from a default position in which the tube is stored in the recess of the extension to a dispensing position in which the tube is elevated out of the recess and moved forwardly to position the tube directly over the bristles for dispensing toothpaste from the container through the open end of the tube. The toothbrush of the present invention provides a convenient, compact toothbrush with an integrated supply of tooth paste that is convenient for use at home and ideal for use when travelling or away from home. The dispensing tube is sealed when the actuating mechanism is in the default position to prevent leakage.

10 Claims, 3 Drawing Sheets

TOOTHBRUSH

FIELD OF THE INVENTION

This invention relates generally to a toothbrush and, more particularly, to a toothbrush that incorporates a tooth paste container and a tooth paste dispensing system.

BACKGROUND OF THE INVENTION

An important part of a person's daily hygiene routine is the brushing of one's teeth. This requires a person to secure and use two separate components: a toothbrush and a tooth paste supply container. Particularly when away from home, brushing one's teeth is often overlooked or put off as it is often inconvenient to carry and store both items.

There are many types of toothbrush devices that have been developed that combine the toothbrush and a container for tooth paste in an attempt to address the foregoing problem. Examples of such devices include:

U.S. Pat. No. 4,826,341 to Kwak
U.S. Pat. No. 4,717,278 to Kemeny
U.S. Pat. No. 5,039,244 to Cheng
U.S. Pat. No. 4,013,370 to Gingras
U.S. Pat. No. 4,155,663 to Cerquozzzi
U.S. Pat. No. 4,408,920 to Walther et al
U.S. Pat. No. 2,243,774 to V. J. Resh
U.S. Pat. No. 2,642,606 to T. T. Aschenbach
U.S. Pat. No. 2,717,101 to A. B. Van Handel
U.S. Pat. No. 1,504,143 to W. E. Roberts
U.S. Pat. No. 1,610,831 to A. Wallace
U.S. Pat. No. 1,860,911 to H. L. Trimble
U.S. Pat. No. 3,995,648 to Kuryla
U.S. Pat. No. 3,391,980 to R. D. Duncan
U.S. Pat. No. 3,612,706 to Francesco Verga
U.S. Pat. No. 3,256,894 to G. R. Sherman
U.S. Pat. No. 3,261,367 to J. J. Pickering
U.S. Pat. No. 2,766,471 to C. S. Durrett
U.S. Pat. No. 4,421,433 to Villanueva
U.S. Pat. No. 5,062,728 to Kuo
U.S. Pat. No. 5,158,383 to Glover et al
U.S. Pat. No. 5,407,287 to Braun et al None of these prior art toothbrushes use a convenient and re-sealable built-in dispensing system that is designed to apply toothpaste directly to the top of the toothbrush bristles.

SUMMARY OF THE INVENTION

Accordingly, the present invention provides a toothbrush comprising, in combination:

a replaceable container for holding toothpaste having an outlet;

a brush portion having a plurality of projecting bristles and an extension that includes a recess; and a dispensing system comprising a tube and an actuating mechanism mounted to the extension, the tube being in communication with the outlet of the container and having an open end and the actuating mechanism being operable to pivot the tube from a default position in which the tube is stored in the recess of the extension to a dispensing position in which the tube is elevated out of the recess and moved forwardly to position the tube directly over the bristles for dispensing toothpaste from the container through the open end of the tube.

Preferably, the toothbrush portion is attached to a tooth paste container that contains tooth paste under pressure. The tooth paste is released from the container through a valve. The toothbrush portion can include an additional switch to activate the valve to release tooth paste under pressure from the container to the tube when in the dispensing position.

The present invention provides a compact and convenient toothbrush with a built-in toothpaste container and dispenser. The toothbrush is designed for simple and reliable operation.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
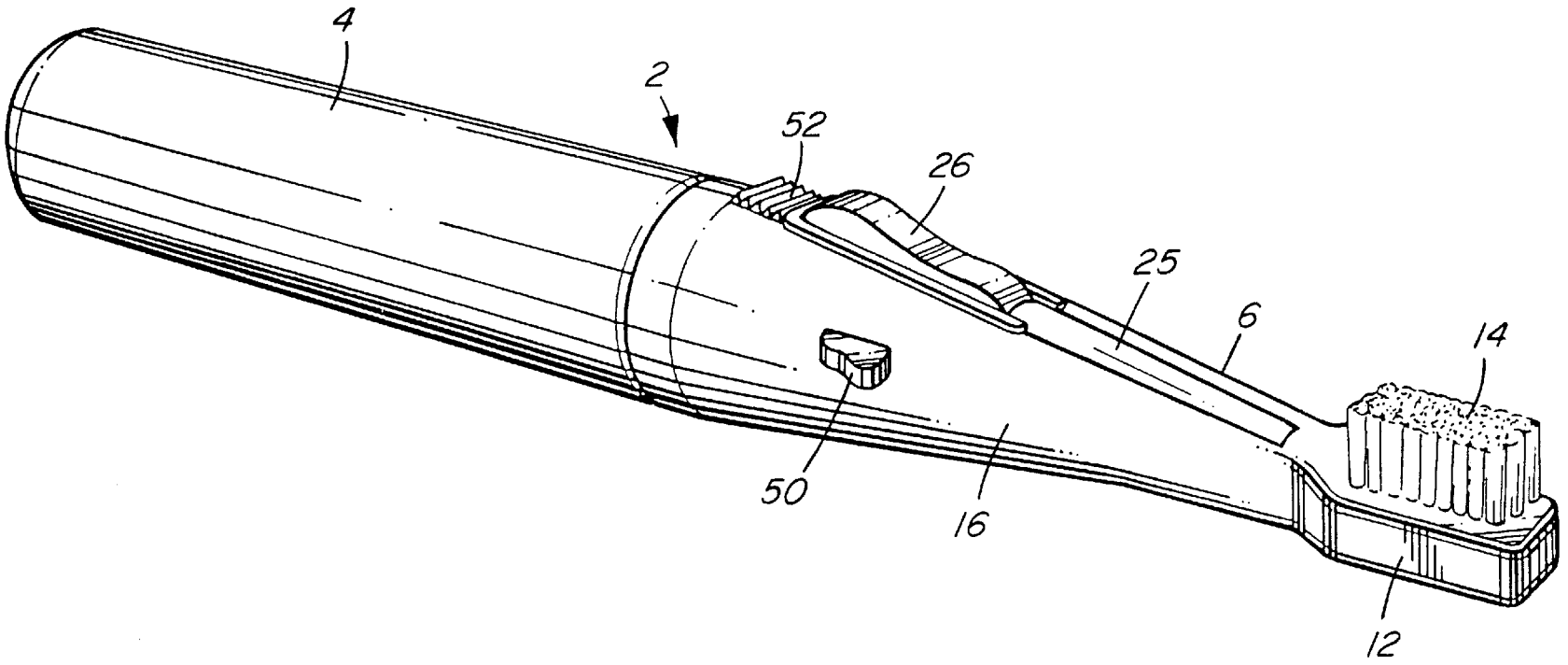
FIG. 1 is a perspective view of a preferred embodiment of the toothbrush of the present invention.
Figure 2:
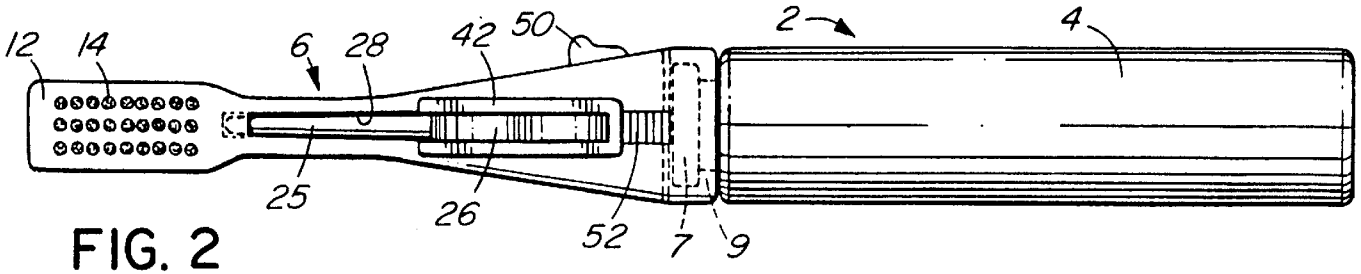
FIG. 2 is a top plan view of the toothbrush of FIG. 1.
Figure 4:
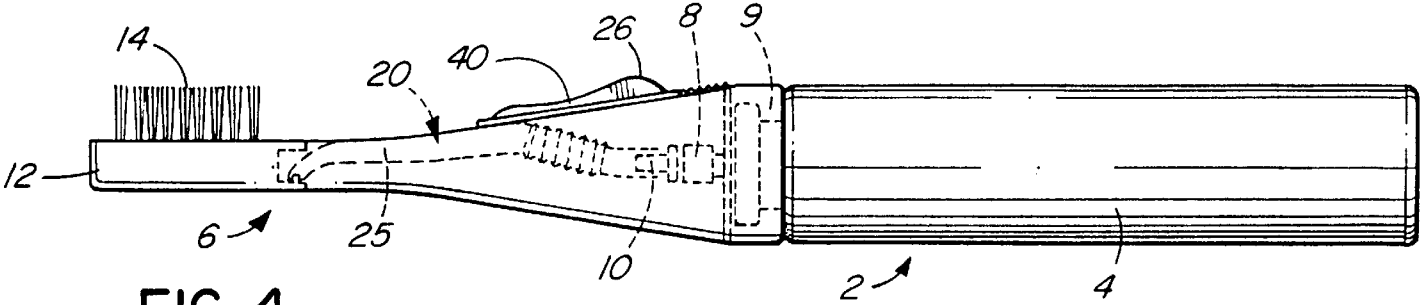
FIG. 4 is a side elevation view of the toothbrush of FIG. 2 with dashed lines showing the tooth paste dispensing system.

Referring to FIGS. 1, 2 and 4, there is shown a toothbrush 2 according to a preferred embodiment of the present invention. The toothbrush comprises a replaceable container 4 for holding toothpaste to which a brush portion 6 is releasably attachable. As best shown in FIGS. 2 and 4, container 4 is formed with a lip 7 and brush portion 6 includes a correspondingly shaped annular flange 9 adapted to engage behind lip 7 to releasably lock the brush portion 6 and container 4 together in a snap tight fit such that the container and the brush portion co-operate to define a handle for grasping by the user.

It will be readily apparent to those skilled in the art that there are alternative ways to releasably connect brush portion 6 to tooth paste container 4 other than the connection system illustrated. Other connection schemes can include threaded or wedging arrangements such that the brush portion 6 is reliably connected to container 4. Furthermore, the illustrated embodiment shows an arrangement in which the toothbrush extension is connected directly to container 4. It is also possible for container 4 to be housed in a hollow handle structure with the handle and brush portion formed with cooperating connection means to permit attachment of the brush to the handle while toothpaste container 4 is retained in the handle.

In the illustrated embodiment, container 4 holds fluid tooth paste under pressure. The container includes a conventional valve 8 that is depressed to release tooth paste through outlet 10. Once again, it will be appreciated that the toothbrush of the present invention is not limited to a pressurized container of tooth paste. Other containers are contemplated such as a conventional squeezable tooth paste tube or a rigid container that relies on a piston or plunger to advance tooth paste from the container.

Brush portion 6 includes a conventional toothbrush head 12 formed with a plurality of projecting bristles 14. Extension 16 extends rearwardly from head 12 for mounting to container 4 via flange 9 as previously described.

Figure 3:
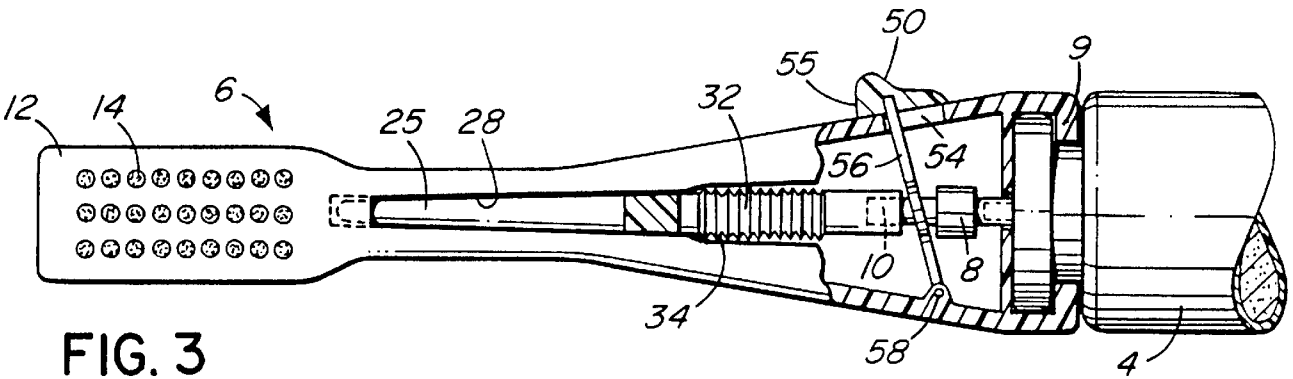
FIG. 3 is a detail view with broken away sections showing the tooth paste dispensing system of the present invention.

In the preferred embodiment, and, as best illustrated in FIG. 3, extension 16 is generally hollow and houses the tooth paste dispensing system 20 of the present invention. The dispensing system includes a tube 25 that is connected to an actuating mechanism in the form of switch 26. Switch 26 is slidably mounted to extension 16. A recess 28 is formed in extension 16. The lower portion of recess 28 is dimensioned to accept and hold tube 25. Tube 25 extends rearwardly from its point of attachment at 29 to switch 26 to communicate with outlet 10 of tooth paste container 4. It will be appreciated that the connection scheme used to attach brush portion 6 to container 4 will have to be designed to accommodate connection of tube 25 to outlet 10, preferably by a press fitting engagement of one within the other.

Tube 25 extends forwardly to an open end 30. Preferably, tube 25 is substantially rigid adjacent open end 30 and includes a flexible portion 32 adjacent container outlet 10. In the illustrated embodiment, flexible portion 32 is defined by a series of accordion folds 34 that can expand and contract to accommodate movement of tube 25 in order to dispense tooth paste as will be explained in more detail below. Flexible portion 32 can also be formed using a loop of flexible tubular material.

Associated with tube 25 is actuating switch 26 which is operated to pivot tube 25 from a default position in which the tube is stored in recess 28 of extension 16 to a dispensing position in which the tube is elevated out of the recess and moved forwardly to position the tube directly over bristles 14. Tube 25 then forms a passageway for delivering toothpaste from container 4 directly to the bristles.

Switch 26 is preferably a rocker switch that is pivotally mounted at 40 to a movable frame 42 that is slidable along extension 16. For example, frame 42 can be formed with outer grooves that slidably engage the edges of recess 28 to permit movement of switch 26 along the recess. Tube 25 is attached to the front portion of switch 26 at 29 for pivotal and sliding movement with the switch.

Preferably, a biasing member in the form of resilient, stretchable cover 52 is provided between switch 26 and the upper end 54 of recess 28. Cover 52 is preferably made from rubber and tends to urge switch 26 toward the default position in which tube 25 is stored in recess 28. Cover 52 also acts to shield the hollow interior of extension 16 from the external environment.

Figure 5:
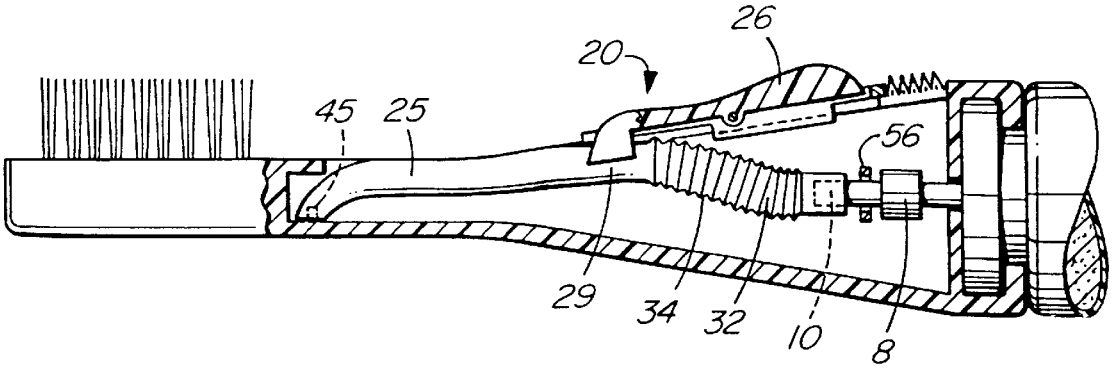
FIG. 5 is a detail view with broken away sections showing the dispensing system of the present invention in the default stored position with the tube in the recess.
Figure 6:
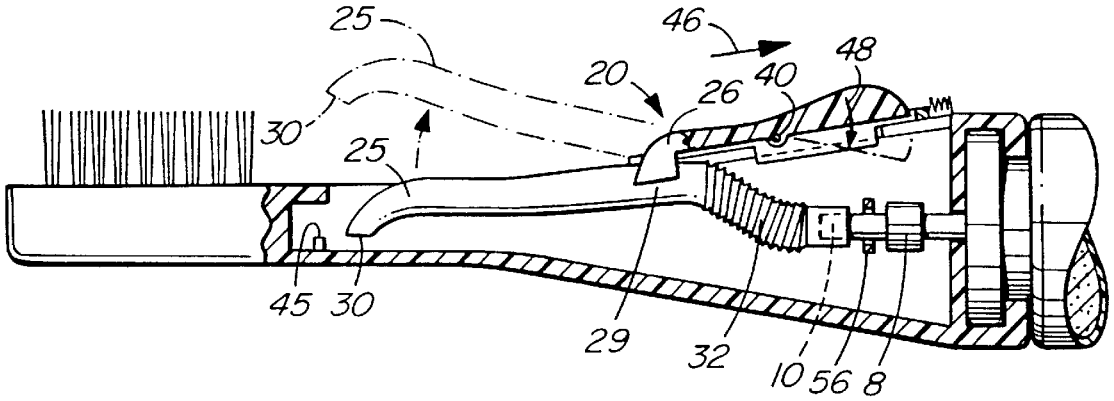
FIG. 6 is a detail view with broken away sections showing how the dispensing system of the present invention is moved to an intermediate position to release the dispensing tube from the recess.
Figure 7:
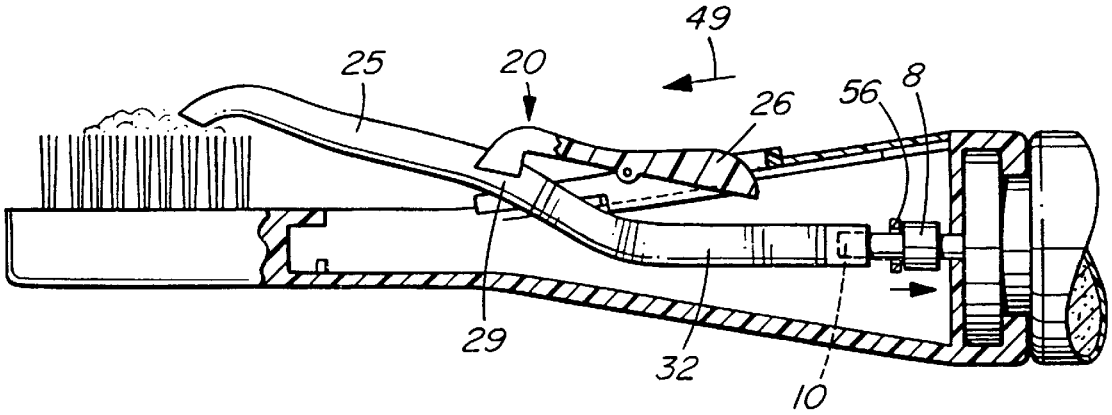
FIG. 7 is a detail view with broken away sections showing the dispensing system of the present invention in the dispensing position.

The operation of the dispensing system is illustrated in FIGS. 5 to 7. FIG. 5 shows the dispensing system in its default position with tube 25 positioned within recess 28. Preferably, recess 28 and tube 25 are dimensioned and shaped such that the upper surface of extension 16 presents a smoothly rounded appearance when tube 25 is stored within the recess. Recess 28 includes a sealing member 45 positioned to engage in and seal the open end 30 of tube 25.

FIG. 6 is an intermediate position in which switch 26 is moved a short distance rearwardly as indicated by arrow 46 to release the open end 30 of tube 25 from sealing member 45. Note that cover 52 is deformed and flexible portion 32 of tube 25 is initially compressed to accommodate rearward movement of the switch. At this intermediate position, switch 26 is pivoted about point 40 as shown by arrow 48 to pivot attached tube 25 out of recess 28 (see dashed lines). Flexible portion 32 of tube 25 is now elongated slightly to accommodate the pivoting movement of the tube.

In FIG. 7, switch 26 is shown being advanced forwardly to move the open end 30 of tube 25 over bristles 14 as indicated by arrow 48 to the dispensing position. Cover 52 and flexible tube portion 32 are now stretched by movement to this position. At this point, tooth paste can be dispensed from container 4 directly to the top of the bristles.

In the illustrated preferred embodiment in which container 4 contains tooth paste under pressure, a switch 50 is provided to depress valve 8 to deliver tooth paste to the bristles. As best shown in FIG. 4, switch 50 comprises an external member 55 for manipulation by the user. Member 55 is connected to a pair of generally parallel elongate wire portions 56 via a slot 57 in extension 16. Wire portions 56 extend across the interior of extension 16 to pivot point 58. Wire portions 56 are spaced far enough apart to straddle and move past container outlet 10 and tube 25 when external member 55 is moved toward container 4 by the thumb of a user, however, the wires do engage and press valve 8 causing tooth paste to be discharged from outlet 10 and into tube 25 for delivery directly to bristles 14.

Although the present invention has been described in some detail by way of example for purposes of clarity and understanding, it will be apparent that certain changes and modifications may be practised within the scope of the appended claims.

I claim:

1. A toothbrush comprising, in combination:

a replaceable container for holding toothpaste having an outlet;

a brush portion having a plurality of projecting bristles and an extension mountable to the container to position the brush portion at a fixed distance from the container, the extension including a recess; and a dispensing system comprising a tube and an actuating mechanism mounted to the extension, the tube being in communication with the outlet of the container and having an open end and the actuating mechanism being operable to pivot the tube from a default position in which the tube is stored in the recess of the extension to a dispensing position in which the open end of the tube is elevated out of the recess and moved forwardly with respect to the brush portion and the container to position the open end directly over the bristles for dispensing toothpaste from the container.

2. A toothbrush as claimed in claim 1 in which the toothpaste container holds toothpaste under pressure and includes a valve at the outlet to control the flow of toothpaste from the container.

3. A toothbrush as claimed in claim 2 including a switch to activate the valve to release toothpaste under pressure from the container to the tube.

4. A toothbrush as claimed in claim 1 in which the recess includes a sealing member to engage in and seal the open end of the tube when the tube is stored within the recess.

5. A toothbrush as claimed in claim 1 in which the tube is substantially rigid adjacent the open end and includes a flexible portion adjacent the container outlet to accommodate the pivoting and sliding movement of the actuating mechanism.

6. A toothbrush as claimed in claim 5 in which the flexible portion of the tube is formed with accordion folds.

7. A toothbrush as claimed in claim 1 in which the actuating mechanism is a pivoting switch that is pivotally mounted to a movable frame that is slidable along the extension, the tube being coupled to the switch for pivotal and sliding movement with the switch.

8. A toothbrush as claimed in claim 1 including a biasing member to bias the actuating mechanism toward the default position in which the tube is stored in the recess of the extension.

9. A toothbrush as claimed in claim 1 in which the brush portion is releasably mountable to the replaceable container.

10. A toothbrush head for releasable attachment to a container of toothpaste having an outlet, the toothbrush head comprising:

a brush portion having a plurality of projecting bristles and an extension adapted to be releasably mounted to the container to position the brush portion at a fixed distance from the container, the container and the extension co-operating to define a handle to be grasped by a user when the extension is mounted to the container;

a recess formed in the extension; and a dispensing member comprising a tube and an actuating mechanism mounted to the brush portion, the tube being connectable with the outlet of the container and having an open end, and the actuating mechanism being operable to pivot the tube from a default position in which the tube is stored in the recess of the extension to a dispensing position in which the tube is elevated out of the recess and moved forwardly with respect to both the brush portion and the container to position the tube directly over the bristles for dispensing toothpaste from the container through the open end of the tube.

* * * * *